US005091099A

United States Patent [19]

Evans et al.

[11] Patent Number: 5,091,099

[45] Date of Patent: Feb. 25, 1992

[54] LUBRICATING OIL COMPOSITION

[75] Inventors: Samuel Evans; Rolf Schumacher, both of Marly, Switzerland

[73] Assignee: Ciba-Geigy Corporation, Ardsley, N.Y.

[21] Appl. No.: 360,646

[22] Filed: Jun. 1, 1989

[30] Foreign Application Priority Data

Jun. 9, 1988 [CH] Switzerland ..... 2196/88

[51] Int. Cl.[5] ..... C10M 141/08

[52] U.S. Cl. ..... 252/48.6; 252/50; 252/56 R

[58] Field of Search ..... 252/50, 47.5, 33.6, 252/48.2, 51.5 R, 401, 404, 48.6, 56 R; 564/433

[56] References Cited

U.S. PATENT DOCUMENTS

| | | | |
|---|---|---|---|
| 2,009,480 | 7/1935 | Craig | 252/50 |
| 2,691,632 | 10/1954 | Harle | 252/33.6 |
| 3,322,649 | 5/1967 | O'Shea | 252/48.2 |
| 3,345,292 | 10/1967 | Neale et al. | 252/48.2 |
| 3,368,975 | 2/1968 | Davis et al. | 252/51.5 A |
| 3,505,225 | 4/1970 | Wheeler | 252/33.6 |
| 4,370,434 | 1/1983 | Kline | 252/404 |
| 4,704,219 | 11/1987 | Shaw | 252/50 |
| 4,741,846 | 5/1988 | Evans | 252/47.5 |
| 4,759,862 | 7/1988 | Meier | 252/47.5 |
| 4,824,601 | 4/1989 | Franklin | 252/401 |
| 4,846,985 | 7/1989 | Rizvi et al. | 252/47.5 |

FOREIGN PATENT DOCUMENTS

| | | |
|---|---|---|
| 0059168 | 9/1982 | European Pat. Off. . |
| 0079855 | 5/1983 | European Pat. Off. . |
| 0323403 | 7/1989 | European Pat. Off. . |

*Primary Examiner*—Margaret B. Medley
*Attorney, Agent, or Firm*—JoAnn Villamizar

[57] ABSTRACT

Phosphite-free lubricating oil composition which comprises a) a mineral oil or a synthetic oil or a mixture thereof, and b) a mixture containing at least one aromatic amine of the formula (I), (I)

in which $R^1$, $R^2$, $R^3$ and $R^{3'}$ are as defined in claim 1, and at least one phenol of the formula (II)

in which $R^4$, $R^5$ and A are as defined in claim 1, and the compounds are present in the mixture in a ratio of 2 to 6 parts by weight of the aromatic amine(s) of the formula I to 1 part by weight of the phenol(s) of the formula II.

The lubricating oil compositions are highly resistant to ageing and are effective in preventing black sludge formation.

14 Claims, No Drawings

LUBRICATING OIL COMPOSITION

The invention relates to a phosphite-free lubricating oil composition highly resistant to oxidative degradation.

It is known that in order to improve the performance characteristics of lubricants, such as mineral oils or synthetic and semi-synthetic oils, additives are added.

Additives which eliminate oxidative degradation of the lubricants and promote long shelf-life and high performance stability, are very important.

The requirements of modern motor oils under conditions of high temperature oxidation in particular have changed as a result of new construction developments in the field of spark-ignition internal- combustion engines. Thus the present-day engine design generates more oxides of nitrogen which re-enter the crankcase as blow-by gases.

The lubricating oil also acts as a seal between the upper piston ring and cylinder zones, and the combustion chamber. This can lead to contamination by high-boiling fuel components. The foregoing conditions are made more severe by the presence of $NO_x$.

The blow-by gases with their increasing $NO_x$ content make the lubricating oil more susceptible to oxidation and sludge nuclei are formed which ultimately give rise to undesirable sludge deposits; these have become known as black sludge.

It can be assumed that this process represents an $NO_x$-initiated autooxidation of the lubricating oil.

There have been many attempts to improve lubricating oils by the addition of antioxidants.

Thus, EP-A 0,149,422 discloses an antioxidant based on diphenylamines. When this antioxidant is used in lubricants, additional additives, such as hydroxylated thiophenyl ethers, alkylidene bisphenols or thioesters of β-(5-tert-butyl-4-hydroxyl-3-methylphenyl)propionic acid may be employed in order to improve further the basic properties.

WO 87/05320 discloses further antioxidant compositions for use with lubricants. Certain hydroxylated thiomethyl ethers are described which are used in admixture with diphenylamines.

EP-A 0,049,133 discloses a stabilizer composition which is suitable, inter alia, for lubricating oils and contains diphenylamines, phosphites, thiodipropionic acid esters and, if desired, one or more polysubstituted phenols. In view of the possibility of the catalyst being deactivated by phosphorus compounds escaping in the exhaust gas, phosphites as components of a stabilizer for use in motor oils should be present in limited amounts or preferably omitted altogether.

Novel lubricant compositions and particularly lubricating oil compositions have now been found which possess further improved properties compared with the products hitherto made known, are highly resistant to oxidative degradation and are capable of bringing about a lasting reduction of the negative effects of black sludge in spark-ignition internal-combustion engines.

The present invention relates to a phosphite-free lubricating oil composition which comprises a) a mineral oil or a synthetic oil or a mixture thereof, and b) a mixture containing at least one aromatic amine of the formula

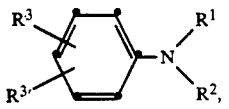

(I)

in which $R^1$ is H, alkyl having 1 to 18 carbon atoms, allyl, methallyl, benzyl or $C_1$–$C_{11}$alkyl-substituted benzyl, $R^2$ is alkyl having 1 to 18 carbon atoms, cycloalkyl having 5 to 12 carbon atoms, cycloalkyl having 5 to 12 carbon atoms substituted by $C_1$–$C_4$alkyl, phenyl, naphthyl or phenyl substituted by —OH, by

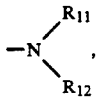

by $C_1$ to $C_{18}$alkoxy, by $C_7$ to $C_9$aralkyl or by one or more alkyl groups having a total of 1 to 24 carbon atoms or is

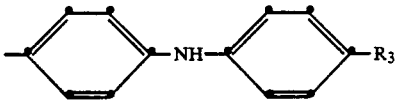

or

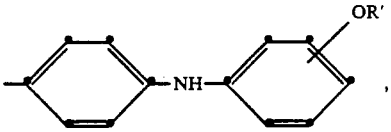

wherein R′ is H or alkyl having 1 to 18 carbon atoms, $R^{11}$ and $R^{12}$ independently of one another are H or alkyl having 1 to 18 carbon atoms, $R^3$ is H, alkyl having 1 to 24 carbon atoms or aralkyl having 7 to 9 carbon atoms, and $R^{3'}$ is H or alkyl having 1 to 24 carbon atoms, and at least one phenol of the formula

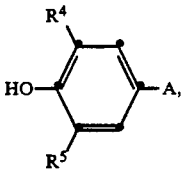

(II)

in which $R^4$ is H, alkyl having 1 to 24 carbon atoms, cycloalkyl having 5 to 12 carbon atoms, cycloalkyl having 5 to 12 carbon atoms substituted by $C_1$–$C_4$alkyl, phenyl or —$CH_2$—S—$R^{10}$, $R^5$ is alkyl having 1 to 24 carbon atoms, cycloalkyl having 5 to 12 carbon atoms, cycloakyl having 5 to 12 carbon atoms substituted by $C_1$–$C_4$alkyl, phenyl or —$CH_2$—S—$R^{10}$, and A is $C_qH_{2q}$—$S_x$—Y or

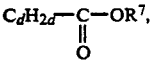

and Y is —H, alkyl having 1 to 18 carbon atoms, phenyl, phenyl substituted by $C_1$–$C_{24}$alkyl, benzyl,

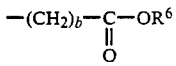

or, if q is 0,

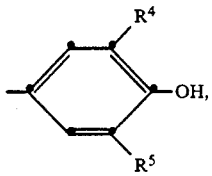

in which $R^4$ and $R^5$ are in each case as defined above, and b is 1 or 2, d is 0, 1, 2 or 3, q is 0, 1, 2 or 3, x is 1, 2, 3 or 4, $R^6$ is $C_1$–$C_{24}$alkyl, $R^7$ is

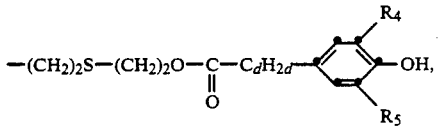

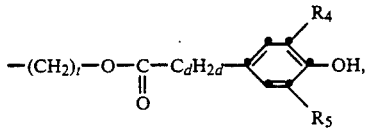

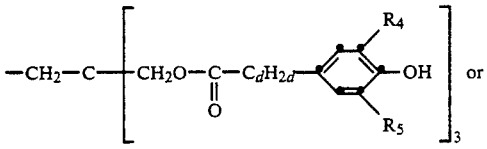

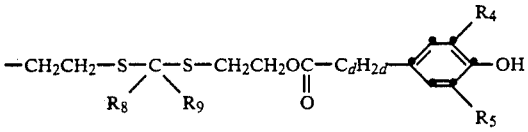

in which d is in each case 0, 1, 2 or 3 and t is 2, 3, 4, 5 or 6 and in which $R^4$ and $R^5$ are in each case as defined above, and $R^8$ and $R^9$ independently of one another are H, alkyl having 1 to 12 carbon atoms, phenyl or phenyl which is substituted by one or two $C_1$ to $C_4$alkyl groups and/or —OH, or $R^8$ and $R^9$ form jointly with the connecting carbon atom a $C_5$–$C_{12}$cycloalkyl group, and $R^{10}$ is $C_1$–$C_{18}$alkyl, phenyl or

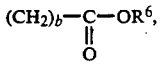

b and $R^6$ being as defined above, and the compounds are present in the mixture in a ratio of 2 to 6 parts by weight of the aromatic amine(s) of the formula I to 1 part by weight of the phenol(s) of the formula II or of phenols containing at least one phenol of the formula II.

The composition according to the invention relates to phosphite-free lubricating oil compositions which comprise (a) a mineral oil or a synthetic oil or a mixture thereof and (b) a mixture as indicated above.

The composition expediently relates according to the invention to those of the type described above where the lubricating oil is an oil for spark-ignition internal-combustion engines.

The invention relates in particular to compositions of the type described above corresponding to the API classifications SF, SG, CD and/or CE, the CRC specifications 1-G 1 or 1-G 2 or the CCMC specifications G 1, G 2, G 3, D 1, D 2, D 3 and/or PD 1.

The compositions accordingly represent motor oils for motor vehicles, essentially for motor car engines and motor vehicles engines, which correspond in the API (American Petroleum Institute) classification to the categories SF and CD or SG and CD, in the CRC (Coordinating Research Council) classification to the standardized Caterpillar Tests 1-G 1 or 1-G 2 and in the CCMC (Committee of Common Market Automobile Constructors) classification to the categories 1 or 2.

Preferred compositions having the above specifications can be accordingly derived from the compounds of the formulae I and II, designated as expedient or preferred, according to the description given below.

The compounds are expediently present in the mixture in a ration of 4 to 5 parts by weight, preferably 4.5 parts by weight, of the aromatic amine(s) of the formula I to 1 part by weight of the phenol(s) of the formula II or of phenols containing at least one phenol of the formula II.

In the compositions according to the invention the substituent $R^2$ in an expedient embodiment is in the compounds of the formula I phenyl, naphthyl or phenyl which is substituted by one or more alkyl groups having a total of 1 to 18 carbon atoms, and $R^2$ is preferably phenyl or phenyl substituted by one or more alkyl groups having a total of 4 to 8 carbon atoms.

In the compositions according to the invention, the preferred substituent $R^1$ in compounds of the formula I is -H.

Expedient compositions are those in which $R^3$ in the compounds of the formula I is H, alkyl having 1 to 18 carbon atoms or aralkyl having 7 to 9 carbon atoms, and compounds in which $R^3$ is H or alkyl having 4 to 8 carbon atoms are preferred. In the preferred embodiment, $R^3$ is in the para (or 4), position. Expedient compositions are those in which $R^{3'}$ in compounds of the formula I is H or alkyl having 4 to 8 carbon atoms. In the preferred embodiment $R^{3'}$ is in the ortho (or 2) position.

The composition according to the present invention may comprise several aromatic amines of the formula I, the mixture expediently containing a) diphenylamine,
b) 4-tert-butyldiphenylamine
c) i) 4-tert-octyldipenylamine
c) ii) 4,4'-di-tert-butyldiphenylamine
c) iii) 2,4,4'-tris-tert-butyldiphenylamine
d) i) 4-tert-butyl-4'-tert-octyldiphenylamine
d) ii) o,o'-, m,m'- or p,p'-di-tert-octyldiphenylamine
d) iii) 2,4-di-tert-butyl-4'-tert-octyldiphenylamine
e) i) 4,4'-di-tert-octyldiphenylamine
e) ii) 2,4-di-tert-octyl-4'-tert-butyldiphenylamine, the amounts of the aromatic amines in the mixture being preferably not more than 5% by weight of diphenylamine a), 8 to 15% by weight of 4-tert-butyldiphenylamine b), 24 to 32% by weight of compounds selected from the group c), 23 to 34% by weight of compounds selected from the group d) and 21 to 34% by weight of compounds selected from the group e), the individual amounts totalling to 100% of the mixture.

In addition to at least one compound of the formula I selected from the range of aromatic amines, the present compositions comprise at least one compound of the formula II selected from the range of the phenols.

Expedient compounds of the formula II are those in which A in the formula II is $C_qH_{2q}—S_x—Y$, q is 0 or 1, x is 1 or 2 and Y is alkyl having 4 to 18 carbon atoms, phenyl, $C_2$ to $C_8$alkyl-substituted phenyl or $$—CH_2—\underset{\underset{O}{\|}}{C}—OR^6,\ R^6$$

being $C_1$ to $C_{18}$alkyl and A being preferably $CH_2$—S—Y, where Y is $C_8$–$C_{12}$-alkyl or $$—CH_2—\underset{\underset{O}{\|}}{C}—OR^6$$

and $R^6$ is $C_8$ to $C_{13}$alkyl and in particular iso-$C_8$ to iso-$C_{13}$alkyl.

In preferred compounds of the formula II, A is $$—C_dH_{2d}—\underset{\underset{O}{\|}}{C}—OR^7,$$

where d is 2 or 3 and $R^7$ is

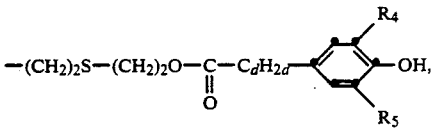

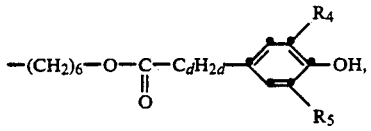

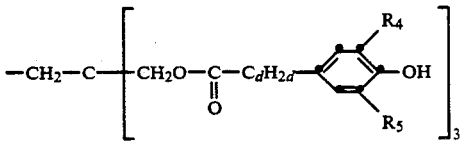

or

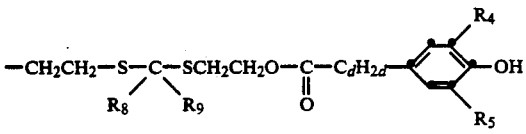

where d is 2 or 3 in each case, $R^4$ and $R^5$ are as defined above and $R^8$ and R9 independently of one another are H, $C_1$ to $C_9$alkyl or phenyl or

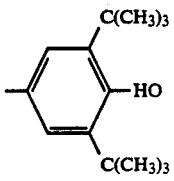

$R^7$ preferably is

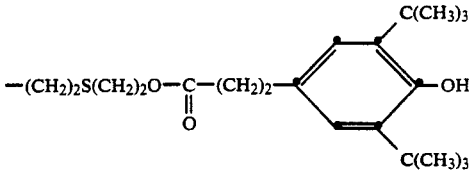

In another expedient embodiment, A in the compounds of the formula II is

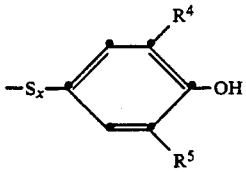

where x is 1 or 2, $R^4$ is H or $C_1$ to $C_5$alkyl and $R^5$ is $C_1$ to $C_5$alkyl, and $R^4$ and $R^5$ are in each case preferably tert-butyl.

Compositions which comprise compounds of the formula II where $R^4$ is hydrogen or alkyl having 1 to 4 carbon atoms and preferably is alkyl having 4 carbon atoms and in particular tert-butyl, are particularly expedient.

Compositions which correspond to an expedient embodiment, are those in which $R^5$ in compounds of the formula II is alkyl having 1 to 4 carbon atoms, preferably alkyl having 4 carbon atoms and in particular tert-butyl.

Preferred compounds of the formula II are further

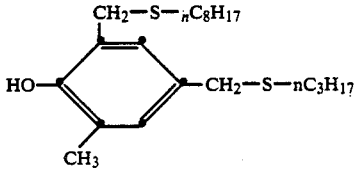

and/or

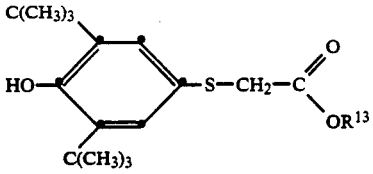

where $R^{13}$ is i-$C_8H_{17}$ to i-$C_{13}H_{27}$ and in particular i-$C_8H_{17}$ or i-$C_{13}H_{27}$.

Examples of $R^1$, $R^2$ and R′ as alkyl having 1 to 18 carbon atoms are methyl, ethyl, propyl, isopropyl, n-butyl, isobutyl, 2-butyl, tert-butyl, pentyl, isopentyl, hexyl, heptyl, 3-heptyl, octyl, 2-ethylhexyl, nonyl, decyl, undecyl, dodecyl, tridecyl, tetradecyl, pentadecyl, hexadecyl, heptadecyl or octadecyl, and others are isoamyl, 2-ethylbutyl, 1-methylpentyl, 1,3-dimethylbutyl, 1,1,3,3-tetramethylbutyl, 1-methylhexyl, isoheptyl, 1-methylheptyl, 1,1,3-trimethylhexyl, 1-methylundecyl, and others. Alkyl having 1 to 24 carbon atoms also comprises, for example, eicosyl, hemicosyl and docosyl. $R^2$, $R^4$ and $R^5$ as cycloalkyl having 5 to 12 carbon atoms can be cyclopentyl, cyclohexyl, cycloheptyl, cyclooctyl, cyclononyl, cyclodecyl, cycloundecyl or cyclododecyl or, furthermore, the $C_5$–$C_{12}$cycloalkyl group can be unsubstituted or substituted by $C_1$–$C_4$-alkyl and can be, for example, 2- or 4-methylcyclohexyl, dimethylcyclohexyl, trimethylcyclohexyl or t-butylcyclohexyl.

If $R^2$ is substituted phenyl, then the phenyl group can be substituted, for example, by $C_1$–$C_8$alkoxy or by one or more alkyl groups having a total of 24 carbon atoms.

Examples of $C_1$ to $C_{18}$alkoxy are methoxy, ethoxy, propoxy, butoxy, pentoxy, hexoxy, 2-ethylhexoxy or octoxy.

Examples of $C_7$ to $C_9$aralkyl are benzyl and α-methylbenzyl.

Examples of phenyl groups which are substituted by alkylgroups having 1 to 24 carbon atoms are 2-, 3- or 4-methylphenyl, 2-, 3- or 4-ethylphenyl, 2-, 3- or 4-propylphenyl, 2-, 3- or 4-butylphenyl, 2-, 3- or 4-tert-butylphenyl, 2-, 3- or 4-octylphenyl, 2-, 3- or 4-tert-octylphenyl, 2,4-di-tert-butylphenyl or 2,4-di-tert-octylphenyl.

Examples of $C_1$–$C_{11}$alkyl-substituted benzyl are 2-, 3- or 4-methylbenzyl, ethylbenzyl, propylbenzyl, n-butylbenzyl, tert-butylbenzyl, n-octylbenzyl, 3,5-di-tert-octylbenzyl or 2,4-di-tert-butylbenzyl or 2,4-di-tert-octylbenzyl.

Examples of $R^3$ as $C_7$ to $C_9$aralkyl are benzyl or methylbenzyl.

$R^4$, $R^5$ and $R^6$ can be alkyl having 1 to24 carbon atoms. $R^4$ and $R^5$ can also be cycloalkyl having 5 to 12 carbon atoms. Appopriate examples of such alkyl groups and cycloalkyl groups have been given above.

Examples of Y or $R^{10}$, $R^{11}$ or $R^{12}$ as $C_1$ to $C_{18}$alkyl can be found in the preceding text.

Examples of $R^6$ as alkyl radicals having 8 to 13 carbon atoms can be found among the examples given above; examples of iso-compounds are 2-ethylhexyl, 1,1,3,3-tetramethylbutyl, 1-methylheptyl, 1,1,3-trimethylhexyl and 1-methylundecyl. Examples of $R^8$ and $R^9$ as alkyl and cycloalkyl groups can also be found in the preceding text according to the length of the carbon chain.

A preferred composition comprises a mixture of aromatic amines, the amount of the amines totalling 100% by weight, of which not more than 5% by weight is diphenylamine a), 8 to 15% by weight is 4-tert-butyldiphenylamine, 24 to 32% by weight are amines selected from the group 4-tert-octyldiphenylamine, 4,4'-di-tert-butyldiphenylamine, 2,4,4'-tris-tert-butyldiphenylamine, 23 to 34% by weight are amines selected from the group 4-tert-butyl-4'-tert-octyldiphenylamine, o,o'-, m,m'- or p,p'-di-tert-octyldiphenylamine, 2,4-di-tert-butyl-4'-tert-octyldiphenylamine and 21 to 34% by weight of 2,4-di-tert-octyl-4'-tert-butyldiphenylamine and/or 4,4'-di-tert-octyldiphenylamine, and a phenol of the formula

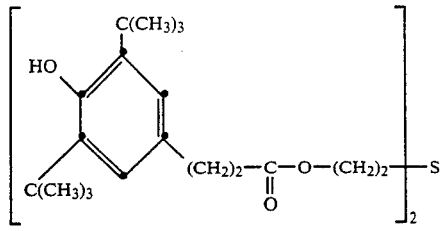

the weight ratio of amines to phenol being 4 to 5:1, preferably 4.5:1.

Another preferred composition comprises a mixture of an aromatic amine of the formula

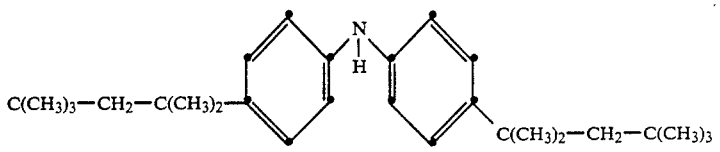

and a phenol of the formula

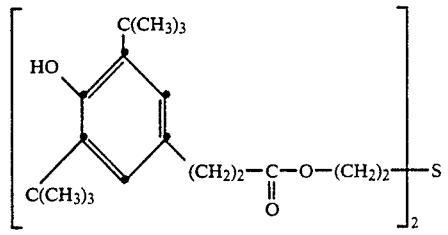

the weight ratio of amine to phenol being 4 to 5:1, preferably 4.5:1.

A further preferred composition comprises a mixture of 4,4'-di-tert-octyldiphenylamine and one or both phenols of the formulae

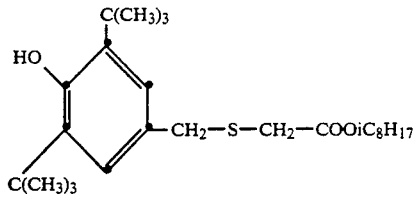

and/or

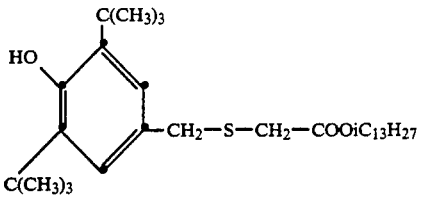

and/or the weight ratio of amine to total phenol being 4 to 5:1, preferably 4.5:1.

Another, also preferred, composition comprises a mixture of aromatic amines, the amount of the amines totalling 100% of which not more than 5% by weight is diphenylamine, 8 to 15% by weight is 4-tert-butyldiphenylamine, 24 to 32% by weight are amines selected from the group 4-tert-octyldiphenylamine, 4,4'-di-tert-butyldiphenylamine, 2,4,4'-tris-tert-butyldiphenylamine, 23 to 34% by weight are amines selected from the group 4-tert-butyl-4'-tert-octyldiphenylamine, o,o'-, m,m'-, or p,p'-di-tert-octyldiphenylamine, 2,4-di-tert-butyl-4'-octyldiphenylamine and 21 to 34% by weight is 2,4-di-tert-octyl-4'-tert-butyldiphenylamine and/or 4,4'-di-tert-octyldiphenylamine, and a phenol of the formula

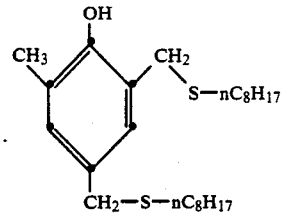

the weight ratio of amine to phenol being 4 to 5:1, preferably 4.5:1.

Likewise preferred is a composition which comprises a mixture containing 4,4'-di-tert-octyldiphenylamine and a mixture of phenols in turn consisting of 30% by weight of

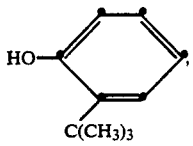

30% by weight of

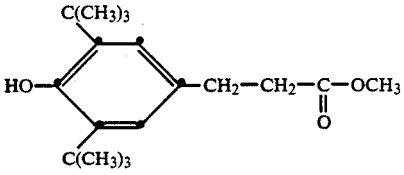

and 40% by weight of

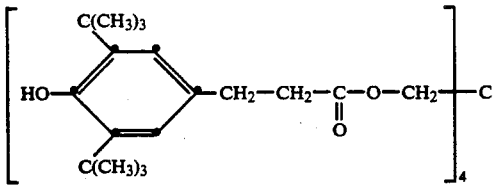

the weight ratio of amine to phenols being 4 to 5:1, preferably 4.5:1.

One group of the diphenylamines used according to the invention, can be prepared, for example, by a process disclosed in EP-A 0,149,422 by reacting diphenylamine with diisobutylene in the presence of an activated alumina catalyst.

The phenols are known and can be prepared, for example, by a process according to DE-A 2,364,121 or DE-A 2,364,126.

These latter processes are distinguished by the fact that a phenol is reacted with methacrylate and a monohydric or dihydric alcohol or a thioester or a monoamine or diamine or a thioether in the presence of an alkaline catalyst.

The mixture according to the invention may contain an amine or a phenol, but it is also possible for the mixture to contain one or more amines and one or more phenols.

The amines and the phenols are first mixed, for example in the stated proportions. This mixture can then be mixed with the finished lubricating oil, for example in amounts from 0.01 to 10% by weight, expediently from 0.1 to 5% by weight and preferably from 0.2 to 2% by weight, based on the finished lubricating oil.

The phenols and amines may be mixed individually with the lubricating oil consecutively, it being important to adhere to the stated mixing and concentration proportions.

Mineral oils or partly or fully synthetic oils may be used as lubricating oils. Such oils and related products are described, for example, in Schewe-Kobek, "Das Schmiermittel-Taschenbuch" ["Lubricant Handbook"], Hüthig Verlag Heidelberg, 4th edition, 1974, or in Dieter Klamann, "Schmierstoffe und artverwandte Produkte" ["Lubricants and Related Products"], Verlag Chemie, Weinheim, 1982.

The lubricating oil may be based, for example, on a mineral oil. The mineral oils are based particularly on hydrocarbon compounds.

Examples of synthetic lubricants comprise lubricants based on aliphatic or aromatic carboxylic esters, polymeric esters, polyalkylene oxides, phosphoric acid esters, poly-α-iolefins or silicones, a diester of a dibasic acid with a monohydric alcohol, for example dioctyl sebacate or dinonyl adipate, a triester of trimethylolpropane with a monobasic acid or a mixture of such acids, for example trimethylolpropane tripelargonate, trimethylolpropane tricaprylate or mixtures thereof, a tetraester of pentaerythritol with a monobasic acid or a mixture of such acids, for example pentaerythritol tetracaprylate, or a complex ester of monobasic or dibasic acids with polyhydric alcohols, for example a complex ester of trimethylolpropane with caprylic and sebacic acid or a mixture thereof. Apart from mineral oils, poly-α-olefins, lubricants based on esters, phosphates, glycols, polyglycols and polyalkylene glycols, for example, are particularly suitable.

The mixtures of phenols and amines described above were able to reduce or suppress the formation of black sludge, ageing by heat and $NO_x$-initiated oxidation of the oil.

The invention also relates to a process for preventing or reducing black sludge formation in lubricating oils of spark-ignition internal-combustion engines, for keeping black sludge particles in suspension in the lubricating oil and for reducing black sludge deposits in the lubrication system of spark-ignition internal-combustion engines, in which process the lubrication system is operating on a phosphite-free lubricating oil composition as described above.

Finally, the invention also relates to the use of the mixtures of phenols and amines described above as antioxidants in lubricating oils.

Accordingly, expedient and preferred lubricating oil compositions can be derived from the above description particularly of compounds of the formula I and the formula II and from their preferred compounds and preferred mixtures with each other.

The lubricating oil compositions comprise according to the invention phenols of the formula II or phenols of which at least one has the formula II. Phenols of which at least one has the formula II, are a mixture of two or more phenols of which at least one corresponds to the formula II; examples of one or more further phenols can be found in the list below, for example under heading 1. "Alkylated monophenols" and/or under heading 7. "Esters of β-(3,5-di-tert-butyl-4-hydroxyphenyl)propionic acid.

The lubricants may additionally contain other additives, added in order to improve still further the basic properties. Such additives are antioxidants, metal passivators, rust inhibitors, viscosity index improvers, pour-point depressants, dispersants, detergents, thickeners, biocides, antifoams, demulsifiers and emulsifiers as well as high-pressure and antiwear additives.

EXAMPLES OF PHENOLIC ANTIOXIDANTS

1. Alkylated monophenols 2,6-di-tert-butyl-4-methylphenol
2,6-di-tert-butylphenol
2-tert-butyl-4,6-dimethylphenol
2,6-di-tert-butyl-4-ethylphenol
2,6-di-tert-butyl-4-n-butylphenol
2,6-di-tert-butyl-4-iso-butylphenol
2,6-di-cyclopentyl-4-methylphenol
2-(α-methylcyclohexyl)-4,6-dimethylphenol
2,6-di-octadecyl-4-methylphenol
2,4,6-tri-cyclohexylphenol
2,6-di-tert-butyl-4-methoxymethylphenol
o-tert-butylphenol

2. Alkylated hydroquinones 2,6-di-tert-butyl-4-methoxyphenol
2,5-di-tert-butylhydroquinone
2,5-di-tert-amylhydroquinone
2,6-diphenyl-4-octadecyloxyphenol

3. Hydroxylated thiodiphenyl ethers 2,2'-thio-bis(6-tert-butyl-4-methylphenol)
2,2'thio-bis(4-octylphenol)

4. Alkylidene bisphenols 2,2'-methylene-bis(6-tert-butyl-4-methylphenol)
2,2'-methylene-bis(6-tert-butyl-4-ethylphenol)
2,2'-methylene-bis[4-methyl-6-(α-methylcyclohexyl)-phenol]
2,2'-methylene-bis(4-methyl-6-cyclohexylphenol)
2,2'-methylene-bis(6-nonyl-4-methylphenol)
2,2'-methylene-bis(4,6-di-tert-butylphenol)
2,2'-ethylidene-bis(4,6-di-tert-butylphenol)
2,2'-ethylidene-bis(6-tert-butyl-4-isobutylphenol or -5-isobutylphenol)
2,2'-methylene-bis[6-(α-methylbenzyl)-4-nonylphenol]
2,2'-methylene-bis[6-(α,α-dimethylbenzyl)-4-nonylphenol]
4,4'-methylene-bis(2,6-di-tert-butylphenol)
4,4'-methylene-bis(6-tert-butyl-2-methylphenol)
1,1-bis(5-tert-butyl-4-hydroxy-2-methylphenyl)butane
2,6-di(3-tert-butyl-5-methyl-2-hydroxybenzyl)-4-methylphenol
1,1,3-tris(5-tert-butyl-4-hydroxy-2-methylphenyl)-3-n-dodecylmercaptobutane
ethylene glycol bis[3,3-bis(3'-tert-butyl-4'-hydroxyphenyl)butyrate]
bis(3-tert-butyl-4-hydroxy-5-methylphenyl)dicyclopentadiene
bis[2-(3'-tert-butyl-2'-hydroxy-5'-methylbenzyl)-6-tert-butyl-4-methylphenyl]terephthalate

5. Benzyl compounds 1,3,5-tris(3,5-di-tert-butyl-4-hydroxybenzyl)-2,4,6-trimethylbenzene
bis(3,5-di-tert-butyl-4-hydroxybenzyl) sulfide
bis(4-tert-butyl-3-hydroxy-2,6-dimethylbenzyl)dithiol terephthalate
1,3,5-tris(3,5-di-tert-butyl-4-hydroxybenzyl) isocyanurate
1,3,5-tris(4-tert-butyl-3-hydroxy-2,6-dimethylbenzyl) isocyanurate
dioctadecyl 3,5-di-tert-butyl-4-hydroxybenzylphosphonate
monoethyl 3,5-di-tert-butyl-4-hydroxybenzylphosphonate calcium salt

6. Acylaminophenols 4-hydroxylauranilide
4-hydroxystearanilide
2,4-bis-octylmercapto-6-(3,5-di-tert-butyl-4-hydroxyanilino)-s-triazine
octyl N-(3,5-di-tert-butyl-4-hydroxyphenyl)carbamate

7. Esters of β-(3,5-di-tert-butyl-4-hydroxyphenyl)propionic acid with monohydric or polyhydric alcohols, for example with

| | |
|---|---|
| methanol | triethylene glycol |
| octadecanol | tris-hydroxyethyl isocyanurate |
| 1,6-hexanediol | bis-hydroxyethyloxalic acid diamide |
| neopentyl glycol | |
| diethylene glycol | |

8. Esters of β-(5-tert-butyl-4-hydroxy-3-methylphenyl)propionic acid with monohydric or polyhydric alcohols, for example with

| | |
|---|---|
| methanol | diethylene glycol |
| octadecanol | triethylene glycol |
| 1,6-hexanediol | pentaerythritol |
| neopentyl glycol | tris-hydroxyethyl isocyanurate |
| | di-hydroxyethyloxalic acid diamide |

9. Amides of β-(3,5-di-tert-butyl-4-hydroxyphenyl)propionic acid, for example N,N'-bis(3,5-di-tert-butyl-4-hydroxyphenylpropionyl)-hexamethylenediamine
N,N'-bis(3,5-di-tert-butyl-4-hydroxyphenylpropionyl)-trimethylenediamine
N,N'-bis(3,5-di-tert-butyl-4-hydroxyphenylpropionyl)-hydrazine

EXAMPLES OF AMINIC ANTIOXIDANTS

N,N'-di-isopropyl-p-phenylenediamine
N,N'-di-sec-butyl-p-phenylenediamine
N,N'-bis(1,4-dimethylpentyl)-p-phenylenediamine
N,N'-bis(1-ethyl-3-methylpentyl)-p-phenylenediamine
N,N'-bis(1-methylheptyl)-p-phenylenediamine
N,N'-dicyclohexyl-p-phenylenediamine
N,N'-di(2-naphthyl)-p-phenylenediamine
4-(p-toluenesulfonamido)diphenylamine N,N'-dimethyl-N,N'-di-sec-butyl-p-phenylenediamine
4-n-butylaminophenol
4-butyrylaminophenol
4-nonanoylaminophenol
4-dodecanoylaminophenol
4-octadecanoylaminophenol
2,6-di-tert-butyl-4-dimethylaminomethylphenol
2,4'-diaminodiphenylmethane
4,4'-diaminodiphenylmethane
N,N,N',N'-tetramethyl-4,4'-diaminodiphenylmethane
1,2-di[(2-methylphenyl)amino]ethane
1,2-di(phenylamino)propane
(o-tolyl)biguanide
di[4-(1',3'-dimethylbutyl)phenyl]amine
2,3-dihydro-3,3-dimethyl-4H-1,4-benzothiazine
phenothiazine
N-allylphenothiazine

EXAMPLES OF FURTHER ANTIOXIDANTS esters of thiodipropionic acid or of thiodiacetic acid, or salts of dithiocarbamide acid or dithiophosphoric acid.

EXAMPLES OF METAL DEACTIVATORS, FOR EXAMPLE FOR COPPER triazoles, benzotriazoles and their derivatives, tolutriazoles and their derivatives, 2-mercaptobenzothiazole, 2-mercaptobenzotriazole, 2,5-dimercaptobenzotriazole, 2,5-dimercaptobenzothiadiazole, 5,5'-methylenebisbenzotriazole, 4,5,6,7-tetrahydrobenzotriazole, salicylidenepropylenediamine, salicylaminoguanidine and their salts.

EXAMPLES OF RUST INHIBITORS a) organic acids and esters, metal salts and anhydrides thereof, for example:

N-oleoylsarcosine, sorbitol monooleate, lead naphthenate, alkenylsuccinic anhydride, for example dodecenylsuccinic anhydride, alkenylsuccinic acid hemiester and hemi-amides, and 4-nonylphenoxyacetic acid.

b) Nitrogenous compounds, for example:

I. primary, secondary or tertiary aliphatic or cycloaliphatic amines and amine salts of organic and inorganic acids, for example oil-soluble alkylammonium carboxylates.

II. Heterocyclic compounds, for example:

substituted imidazolines and oxazolines.

c) Phosphorus compounds, for example:

amine salts of partial esters of phosphoric acid or partial esters of phosphonic acid, zinc dialkyldithiophosphates.

d) Sulfur compounds, for example:

barium dinonylnaphthalenesulfonates, calcium petroleumsulfonates.

EXAMPLES OF VISCOSITY INDEX IMPROVERS polyacrylates, polymethacrylates, vinylpyrrolidone/-methacrylate copolymers, polyvinylpyrrolidones, polybutenes, olefin copolymers, styrene/acrylate copolymers, polyethers.

EXAMPLES OF POUR-POINT DEPRESSANT polymethacrylate, alkylated naphthalene derivatives.

EXAMPLES OF DISPERSANTS/SURFACTANTS polybutenylsuccinamides or -imides, polybutenylphosphonic acid derivatives, basic magnesium, calcium and barium sulfonates and phenolates.

EXAMPLES OF ANTIWEAR ADDITIVES compounds containing sulfur and/or phosphorus and/or halogen, such as sulfurized vegetable oils, zinc dialkyldithiophosphates, tritolylphosphate, chlorinated paraffins, alkyl sulfides, aryl disulfides and aryl trisulfides, triphenylphosphorothionates, diethanolaminomethyltolyltriazole, di(2-ethylhexyl)aminomethyltolyltriazole.

The percentages or parts are by weight, unless stated otherwise.

EXAMPLES

1. Various phenols and amines are added to an Aral base oil (RL 136, commercially available black sludge fail oil), additionally containing 1% of decene. The resultant compositions are subjected to various tests.

In the examples below the designations have the following meanings:

| | | |
|---|---|---|
| Amine (A) | | |
| A mixture of: | | |
| diphenylamine | | 3% |
| 4-tert-butyldiphenylamine | | 14% |
| 4-tert-octyldiphenylamine<br>4,4'-di-tert-butyldiphenylamine<br>2,4,4'-tris-tert-butyldiphenylamine | total of | 30% |
| 4-tert-butyl-4'-tert-octyldiphenylamine<br>o,o',m,m' oder p,p'-di-tert-octyldiphenylamine<br>2,4-di-tert-butyl-4'-tert-octyldiphenylamine | total of | 29% |
| 4,4'-di-tert-octyldiphenylamine | | 18% |
| 2,4-di-tert-octyl-4'-tert-butyldiphenylamine | | 6% |
| Amine (B) | | |
| 4,4'-di-tert-octyldiphenylamine | | |

Phenol (P)

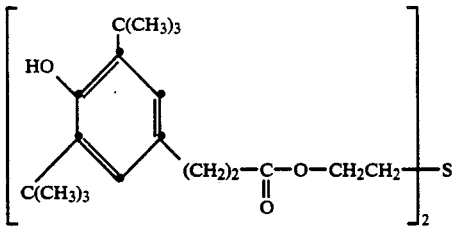

Phenol (S)

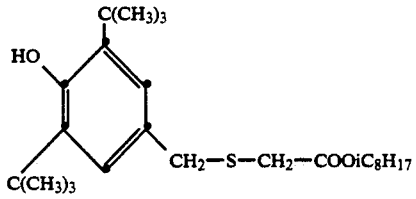

Phenol (T)

-continued

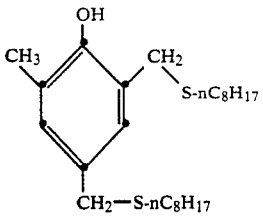

Phenol (U)

mixture of 30% by weight of 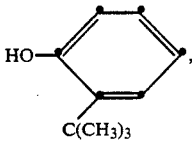

30% by weight of

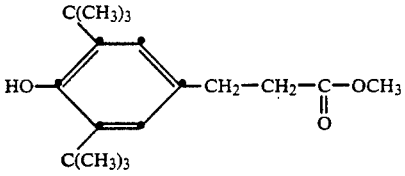

and

40% by weight of

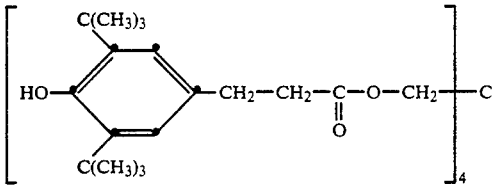

Phenol (V)

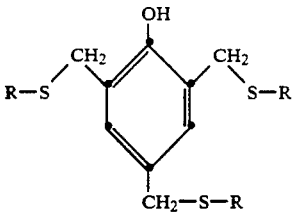

R = $-CH_2COOC_8H_{17}$

Phenol (W)

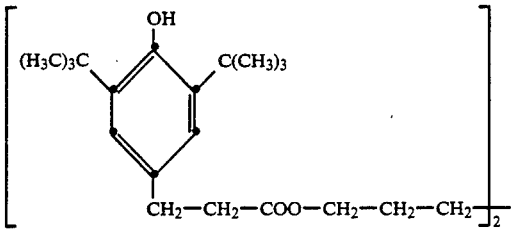

Phenol (X)

-continued

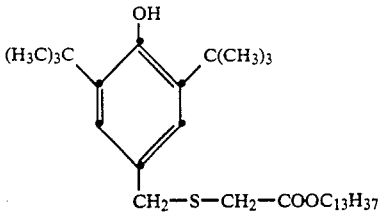

Formulation (1)

base oil containing 0.45% by weight of amine (A) and 0.10% by weight of phenol (P)

Formulation (2)

base oil containing 0.90% by weight of amine (A) and 0.20% by weight of phenol (P)

Formulation (3)

base oil containing 0.45% by weight of amine (B) and 0.10% by weight of phenol (S)

Formulation (4)

base oil containing 0.45% by weight of amine (B) and 0.10% by weight of phenol (P)

Formulation (5)

base oil containing 0.45% by weight of amine (A) and 0.10% by weight of phenol (T)

Formulation (6)

base oil containing 0.45% by weight of amine (A) and 0.10% by weight of phenol (U)

Formulation (7)

base oil containing 0.45% by weight of amine (A) and 0.10% by weight of phenol (V)

Formulation (8)

base oil containing 0.45% by weight of amine (A) and 0.10% by weight of phenol (W)

Formulation (9)

base oil containing 0.45% by weight of amine (A) and 0.10% by weight of phenol (X)

EXAMPLE 2

Ageing of the formulations by heat is carried out in a differential scanning calorimeter (DSC).

The procedure is performed on the following principle: The DSC cell (DuPont thermoanalysis system 1090) consists of a silver heating block. A constantan weight containing the thermo-elements (chromel-alumel), is inserted in this heating block. Sample boats and reference boats are placed on the slightly raised thermo-elements. The inside of the DSC cell is coated by a thin film of gold (corrosion protection). The reference boat remains empty, while three drops of the formulation in question are added to the sample boat. The temperature differences between the sample boat and the reference boat are determined under isothermal conditions. The change in enthalpy dH/dt is in each case given in mW. All measurements are carried out in air +400 ppm of $NO_2$ at a pressure of 8 bar. Aral RL 136, a commercially available black sludge reference oil, is employed as the base oil. 1% of 1-decene is added to this oil in order to boost its susceptibility to oxidation.

During the ageing by heat, the concentration of the added additives decreases continuously. Heat convection dQ/dt increases at a critical additive concentration. The time which elapses during this increase, is known as induction period (onset). The formulations characterized by DSC can be seen in Table 1.

TABLE 1

| Measurements of inductin periods | | |
|---|---|---|
| Test conditions | Formulation (base oil + additives) (% by weight) | Induction period [DSC] [min.] |
| Air + 400 ppm of $NO_2$ 8 bar, 170° C. | no additives | 43.7 |
| Air + 400 ppm of $NO_2$ 8 bar, 170° C. | Formulation 1: 0,45% of amine (A) 0,10% of phenol (P) | 84.7 |
| Air + 400 ppm of $NO_2$ 8 bar, 170° C. | Formulation 2: 0,90% of amine (A) 0,20% of phenol (P) | 121 |
| Air + 400 ppm of $NO_2$ 8 bar, 170° C. | Formulation 3: 0,45% of amine (B) 0,10% of phenol (S) | ~72 |
| Air + 400 ppm of $NO_2$ 8 bar, 170° C. | Formulation 4: 0,45% of amine (B) 0,10% of phenol (P) | 78 |
| Air + 400 ppm of $NO_2$ 8 bar, 170° C. | Formulation 5: 0,45% of amine (A) 0,10% phenol (T) | 91 |
| Air + 400 ppm of $NO_2$ 8 bar, 170° C. | Formulation 6: 0,45% of amine (B) 0,10% of phenol (U) | 78 |
| Air + 400 ppm of $NO_2$ 8 bar, 170° C. | Formulation 7: 0,45% of amine (A) 0,10% of phenol (V) | 74 |
| Air + 400 ppm of $NO_2$ 8 bar, 170° C. | Formulation 8: 0,45% of amine (A) 0,10% of phenol (W) | 83 |
| Air + 400 ppm of $NO_2$ 8 bar, 170° C. | Formulation 9: 0,45% of amine (A) 0,10% of phenol (W) | 93 |

EXAMPLE 3

Ageing of the oils by heat is determined by another independent method. As described in Example 2, the formulations are aged in a DSC pressure cell (DuPont 770) in the conditions air +400 ppm of $NO_2$ at a pressure of 8 bar. The samples aged in the temperature range of 120° C.–150° C. are examined by IR spectroscopy. For this purpose the spectra are standardized to the same film thickness. To characterize the state of oxidation, two peaks are evaluated at 1730 $cm^{-1}$ and at 1630 $cm^{-1}$ [1730 $cm^{-1}$; 6-membered lactone and 1630 $cm^{-1}$: nitrate ester].

Ageing of the oils gives rise to a number of oxidation products. It is possible that in the IR spectrum the absorption bands of these compounds overlap.

For practical considerations the two bands described above which allow a reliable determination of the absorption maximum, are evaluated.

A weakening of these absorption bands is a measure of a reduced oxidation.

TABLE 2

| IR-spectroscopy | | | | |
|---|---|---|---|---|
| Test conditions: air + 400 ppm of $NO_2$, 8 bar | | Formulation (Base oil + | Extinction (IR) | |
| Temp. | Time | additives) | 1730 $cm^{-1}$ | 1630 $cm^{-1}$ |
| 130° C. | 12 h | no additives | 0.312 | 1.376 |
| 130° C. | 12 h | Formulation 1: | 0.216 | 1.074 |

TABLE 2-continued

| IR-spectroscopy | | | | |
|---|---|---|---|---|
| Test conditions: air + 400 ppm of $NO_2$, 8 bar | | Formulation (Base oil + | Extinction (IR) | |
| Temp. | Time | additives) | 1730 $cm^{-1}$ | 1630 $cm^{-1}$ |
| | | 0,45% of amine (A) 0,10% of phenol (P) | | |
| 150° C. | 12 h | no additives | 0.416 | 1.385 |
| 150° C. | 12 h | Formulation 1: 0,45% of amine (A) 0,10% of phenol (P) | 0.377 | 1.467 |

We claim:

1. A phosphite-free lubricating oil composition which comprises a) a mineral oil or a synthetic oil or a mixture thereof, and b) a mixture of (1) aromatic amines as follows:

(a) diphenylamine, (b) 4-tert-butyldiphenylamine (c)(i) 4-tert-octyldiphenylamine (c)(ii) 4,4'-di-tert-butyldiphenylamine (c)(iii) 2,4,4'-tris-tert-butyldiphenylamine (d)(i) 4-tert-butyl-4'-tert-octyldiphenylamine (d)(ii) o,o'-, m,m'- or p,p'-di-tert-octyldiphenylamine (d)(iii) 2,4-di-tert-butyl-4'-tert-octyldiphenylamine (e)(i) 4,4'-di-tert-octyldiphenylamine (e)(ii) 2,4-di-tert-octyl-4'-tert-butyldiphenylamine wherein the amounts of the aromatic amines in the mixture being not more than 5% by weight of diphenylamine (a), 8–15% by weight of 4-tert-dibutyl-diphenylamine (b), 24 to 32% by weight of compounds selected from group (c), 23 to 34% by weight of compounds selected from group (d) and 21 to 34% by weight of compounds selected from group (e), based in each case on the total amount of amines, and (2) at least one phenol of the formula

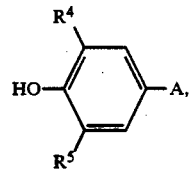

(II)

in which $R^4$ is H, alkyl having 1 to 24 carbon atoms, cycloalkyl having 5 to 12 carbon atoms, cycloalkyl having 5 to 12 carbon atoms substituted by $C_1$–$C_4$alkyl, phenyl or —$CH_2$—S—$R^{10}$, $R^5$ is alkyl having 1 to 24 carbon atoms, cycloalkyl having 5 to 12 carbon atoms, cycloalkyl having 5 to 12 carbon atoms substituted by $C_1$–$C_4$alkyl, phenyl or —$CH_2$—S—$R^{10}$, and A is $C_qH_{2q}$—$S_x$—Y or $$C_dH_{2d}-\underset{\underset{O}{\|}}{C}-OR^7,$$

and Y is —H, alkyl having 1 to 18 carbon atoms, phenyl, phenyl substituted by $C_1$–$C_{24}$alkyl, benzyl,

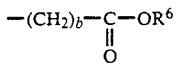

or, if q is 0,

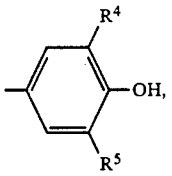

in which $R^4$ and $R^5$ are in each case as defined above, and b is 1 or 2, d is 0, 1, 2 or 3, q is 0, 1, 2 or 3, x is 1, 2, 3 or 4, $R^6$ is $C_1$–$C_{24}$alkyl, $R^7$ is

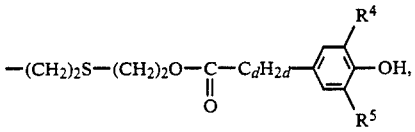

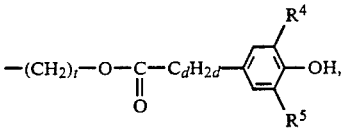

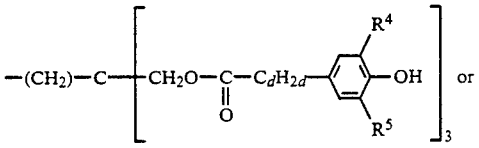

or

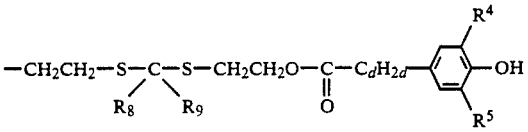

in which d is in each case 0, 1, 2 or 3 and t is 2, 3, 4, 5 or 6 and in which $R^4$ and $R^5$ are in each case as defined above, and $R^8$ and $R^9$ independently of one another are H, alkyl having 1 to 12 carbon atoms, phenyl or phenyl which is substituted by one or two $C_1$ to $C_4$alkyl groups and/or —OH, or $R^8$ and $R^9$ form jointly with the connecting carbon atom a $C_5$–$C_{12}$cycloalkyl group, and $R^{10}$ is $C_1$–$C_{18}$alkyl, phenyl or

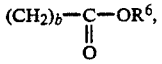

b and $R^6$ being as defined above, wherein the weight ratio of the amine to the phenol is 4 to 5:1.

2. A composition according to claim 1, in which A in the compounds of the formula II is

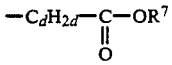

and d is 2 or 3, and $R^7$ is

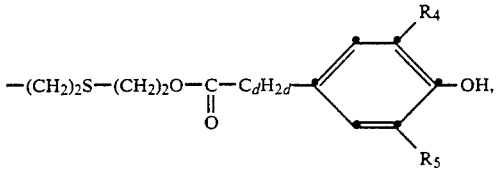

where d is 2 or 3 in each case, $R^4$ and $R^5$ are as defined in claim 1.

3. A composition according to claim 1, in which $R^4$ in the formula II is hydrogen or alkyl having 1 to 4 carbon atoms.

4. A composition according to claim 1, in which $R^5$ in the formula II is alkyl having 1 to 4 carbon atoms.

5. A composition according to claim 1 wherein said phenol is of the formula

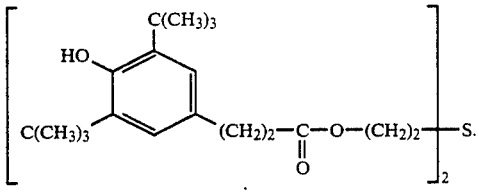

6. A composition according to claim 1, in which the lubricating oil is an oil for spark-ignition internal-combustion engines.

7. A composition according to claim 1 having the API classification SF, SG, CD and/or CE, the CRC specification 1-G 1 or 1-G 2 or the CCMC specification G 1, G 2, G 3, D 1, D 2, D 3 and/or PD 1.

8. A process for preventing or reducing black sludge formation in lubricating oils for spark-ignition internal-combustion engines, for keeping black sludge particles in suspension in the lubricating oil and for reducing black sludge deposits in the lubrication system of spark-ignition internal-combustion engines, in which the lubrication system is operated on a phosphite-free lubricating oil composition according to claim 1.

9. A composition according to claim 4, in which $R^5$ in the formula II is tert-butyl.

10. A composition according to claim 1, in which A in the compound of the formula II is $C_qH_{2q}$—$S_x$—Y, q is 0 or 1, x is 1 or 2 and Y is alkyl having 4 to 18 carbon atoms, phenyl, $C_2$ to $C_8$alkyl-substituted phenyl or

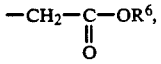

$R^6$ being $C_1$ to $C_{18}$alkyl.

11. A composition according to claim 10, in which A in the compounds of the formula II is

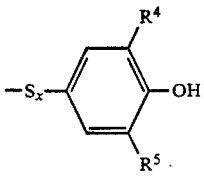

and x is 1 or 2, $R^4$ is H or $C_1$ to $C_5$alkyl and $R^5$ is $C_1$ to $C_5$alkyl.

12. A composition according to claim 1, wherein formula II corresponds to
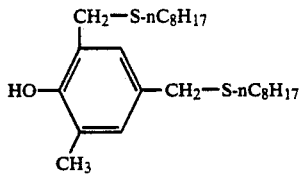
and/or
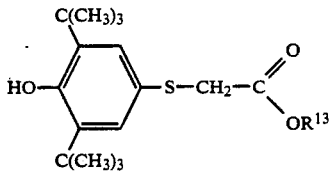
with $R^{13}$ being i-$C_8H_{17}$ to i-$C_{13}H_{27}$.
13. A composition according to claim 1 wherein said phenol is of the formula
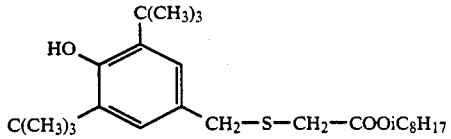
or
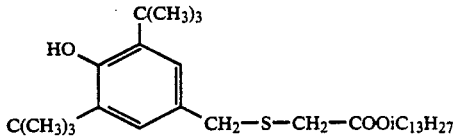
or a mixture thereof.
14. A composition according to claim 1 wherein said phenol is of the formula
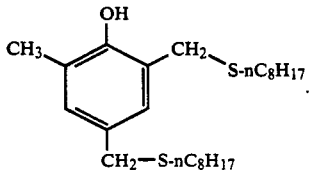
* * * * *